US008540495B2

(12) United States Patent
Yang

(10) Patent No.: US 8,540,495 B2
(45) Date of Patent: Sep. 24, 2013

(54) DUAL DUTY HAND PUMP

(75) Inventor: Chui-Ching Yang, New Taipei (TW)

(73) Assignee: Jiao Hsiung Industry Corp., New Taipei (TW)

( * ) Notice: Subject to any disclaimer, the term of this patent is extended or adjusted under 35 U.S.C. 154(b) by 244 days.

(21) Appl. No.: 13/065,224

(22) Filed: Mar. 17, 2011

(65) Prior Publication Data

US 2012/0097275 A1 Apr. 26, 2012

(30) Foreign Application Priority Data

Oct. 20, 2010 (CN) ..... 99 2 20219 U

(51) Int. Cl.
*F04B 9/14* (2006.01)
*F04B 53/10* (2006.01)

(52) U.S. Cl.
USPC ..... 417/374; 417/437; 137/565.25; 141/65

(58) Field of Classification Search
USPC ..... 417/374, 442, 448, 453, 491, 537, 417/544, 557, 569, 507, 508, 559, 560; 137/565.25, 234.5; 141/65
See application file for complete search history.

(56) References Cited

U.S. PATENT DOCUMENTS

| | | | | | |
|---|---|---|---|---|---|
| 2,164,103 | A * | 6/1939 | Baum | 417/552 |
| 2,262,128 | A * | 11/1941 | Zehner | 417/448 |
| 4,655,690 | A * | 4/1987 | Boedecker et al. | 417/53 |
| 5,361,943 | A * | 11/1994 | Du | 222/134 |
| 5,775,200 | A * | 7/1998 | Tsai | 92/58.1 |
| 5,823,754 | A * | 10/1998 | Lee | 417/437 |
| 6,250,343 | B1 * | 6/2001 | Chen | 141/65 |
| 6,299,420 | B1 * | 10/2001 | Saputo et al. | 417/527 |
| 6,422,832 | B1 * | 7/2002 | Wang | 417/315 |
| 6,955,531 | B2 * | 10/2005 | Wu | 417/571 |
| 2006/0034719 | A1 * | 2/2006 | Chen | 417/569 |
| 2006/0078449 | A1 * | 4/2006 | Chen | 417/570 |

* cited by examiner

*Primary Examiner* — Devon Kramer
*Assistant Examiner* — Nathan Zollinger
(74) *Attorney, Agent, or Firm* — Charles E. Baxley

(57) ABSTRACT

A dual duty hand pump has two air channels, a hand grip, a piston rod, a piston, a deflating unit and an inflating unit. The hand grip and the piston are mounted on two ends of the piston rod. The deflating unit and the inflating unit are respectively mounted in the air channels and respectively have two check valves mounted therein in two opposite directions. When the hand grip is lifted and pressed down, air respectively flows in and flows out of the hand pump through the air channel. Accordingly, the hand pump provides a practical and convenient solution to integrate inflating and deflating functions as a whole for users to flexibly select from when the dual duty hand pump is in use.

18 Claims, 7 Drawing Sheets

DUAL DUTY HAND PUMP

BACKGROUND OF THE INVENTION

1. Field of the Invention

The present invention relates to an air pump, and more particularly to a dual duty hand pump integrating inflating and deflating functions as a whole.

2. Description of the Related Art

A lot of daily objects need inflating or deflating to function properly. For example, packing bags for clothes, pillows or blankets, need to be rapidly deflated so as to tightly wrap up the packed things and keep away dirt and moisture. Other things, such as tires, balloons, balls, need to be inflated to become useful. Certain things, such as bicycle tires, need to be inflated and deflated to maintain a comfortable cycling condition. In a case that both manual inflation and deflation are needed, a hand pump and a hand suction pump respectively dedicated to inflate and deflate need to be at hand. Preparing both tools at the same time is inconvenient. Consequently, it is inconvenient when a user needs to deal with inflating and deflating objects at the same time.

SUMMARY OF THE INVENTION

An objective of the present invention is to provide a dual duty hand pump integrating inflating and deflating functions as a whole.

To achieve the foregoing objective, the dual duty hand pump has a hand grip, a pump body, a piston rod, a piston, a deflating unit and an inflating unit. The pump body is hollow and has a through hole, an air inlet channel, and an air outlet channel. The through hole is formed through one end of the pump body. The air inlet channel and the air outlet channel are formed through the other end of the pump body and communicating with the through hole.

The piston rod is mounted in the pump body and through the through hole of the pump body. One end of the piston rod is connected with the hand grip.

The piston is securely mounted on the other end of the piston rod, and has a seal ring hermetically mounted on an inner wall of the pump body.

The deflating unit is mounted in the air inlet channel and has a check valve through which air flows in a first direction.

The inflating unit is mounted in the air outlet channel and has a check valve through which air flows in a second direction opposite to the first direction.

When the hand grip is pulled, air enters the pump body through the air inlet channel and the check valve mounted inside the air inlet channel. When the hand grip is pushed, air flows out of the pump body through the air outlet and the check valve. Therefore, if an inflated object is connected to the air inlet channel, air inside the inflated object can be deflated to the pump body and exhausted out of the pump body through the air outlet channel. If an inflatable object is connected to the air outlet channel, air entered the pump body through the air inlet channel can inflate the inflatable object through the air outlet channel. The dual duty hand pump provides a solution integrating both deflating and inflating functions as a whole for users to flexibly select from when the dual duty hand pump is in use.

Other objectives, advantages and novel features of the invention will become more apparent from the following detailed description when taken in conjunction with the accompanying drawings.

DETAILED DESCRIPTION OF THE INVENTION

Figure 1:
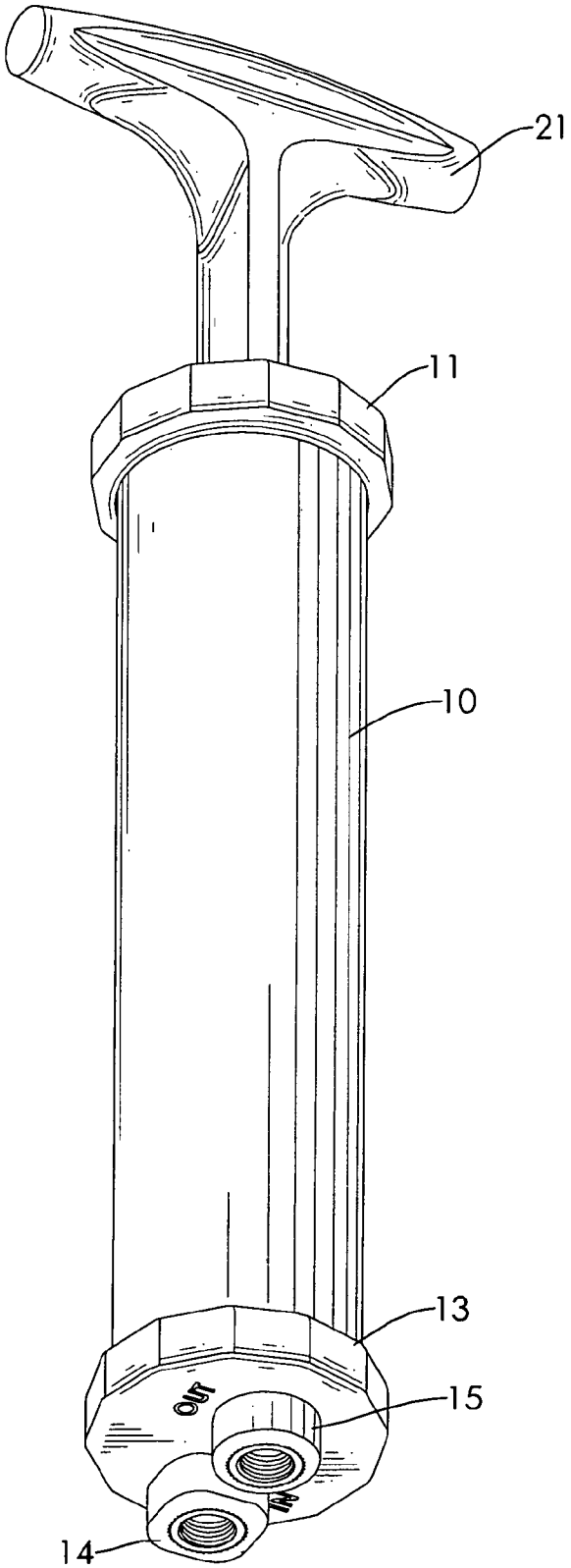
FIG. 1 is a perspective view of a first embodiment of a dual duty hand pump in accordance with the present invention.
Figure 2:
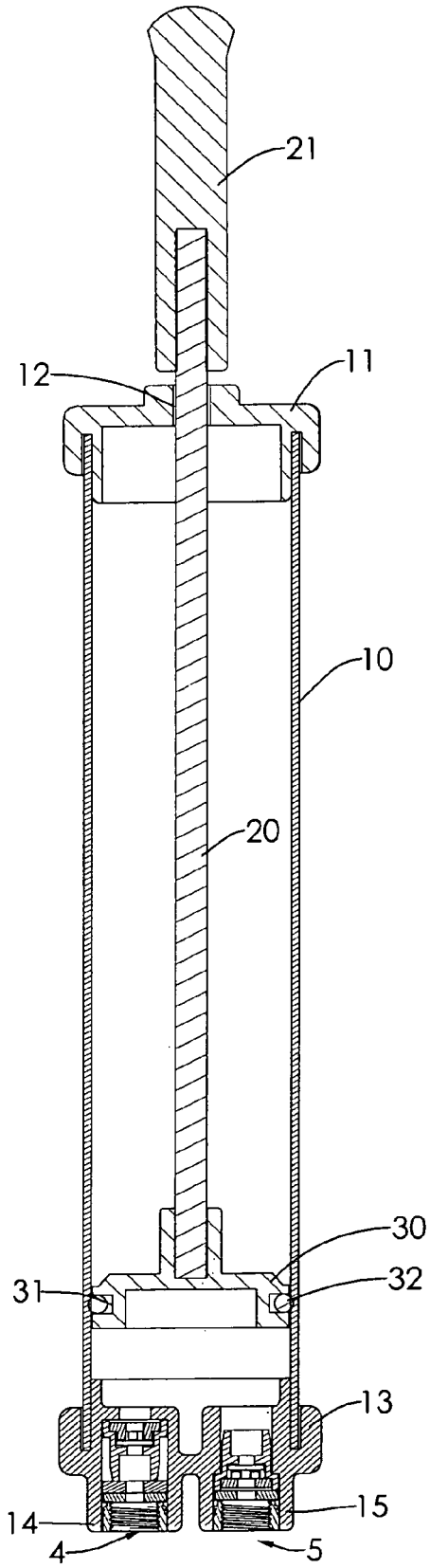
FIG. 2 is a side view in partial section of the hand pump in FIG. 1.

With reference to FIGS. 1 and 2, a first embodiment of a dual duty hand pump in accordance with the present invention has a pump body 10, a piston rod 20, a hand grip 21, a piston 30, a deflating unit 4 and an inflating unit 5.

The pump body 10 is hollow and elongated, and has an opening, a cover 11, a through hole 12 and a base 13. The opening is formed through one end of the pump body 10. The cover 11 covers and seals the opening. The through hole 12 is formed through the cover 11. The base 13 is mounted on the other end of the pump body 10 and has an air inlet channel 14 and an air outlet channel 15. The air inlet channel 14 and the air outlet channel 15 are formed through the base 13.

The piston rod 20 is mounted in the pump body 10 and through the through hole 12 of the cover 11 of the pump body 10. The hand grip 21 is securely mounted on one end of the hand grip 21 outside the pump body 10. The piston 30 is securely mounted on the other end of the piston rod 20 and has an annular slot 31 and a seal ring 32. The annular slot 31 is formed in a periphery of the piston 30. The seal ring 32 is mounted in the annular slot 31 and is hermetically attached on an inner wall of the pump body 10.

Figure 3:
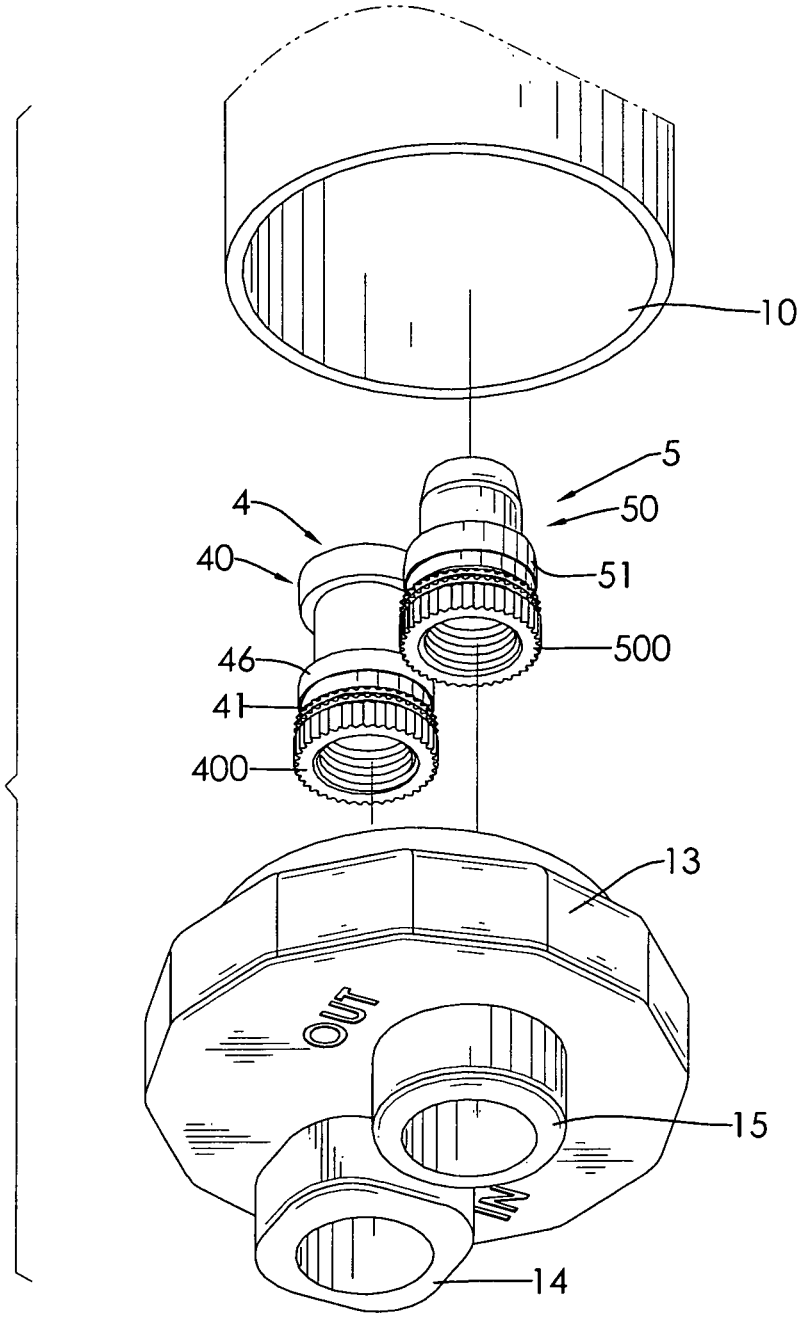
FIG. 3 is an exploded perspective view of a pump body, a deflating unit, an inflating unit and a base of the hand pump in FIG. 1.
Figure 4:
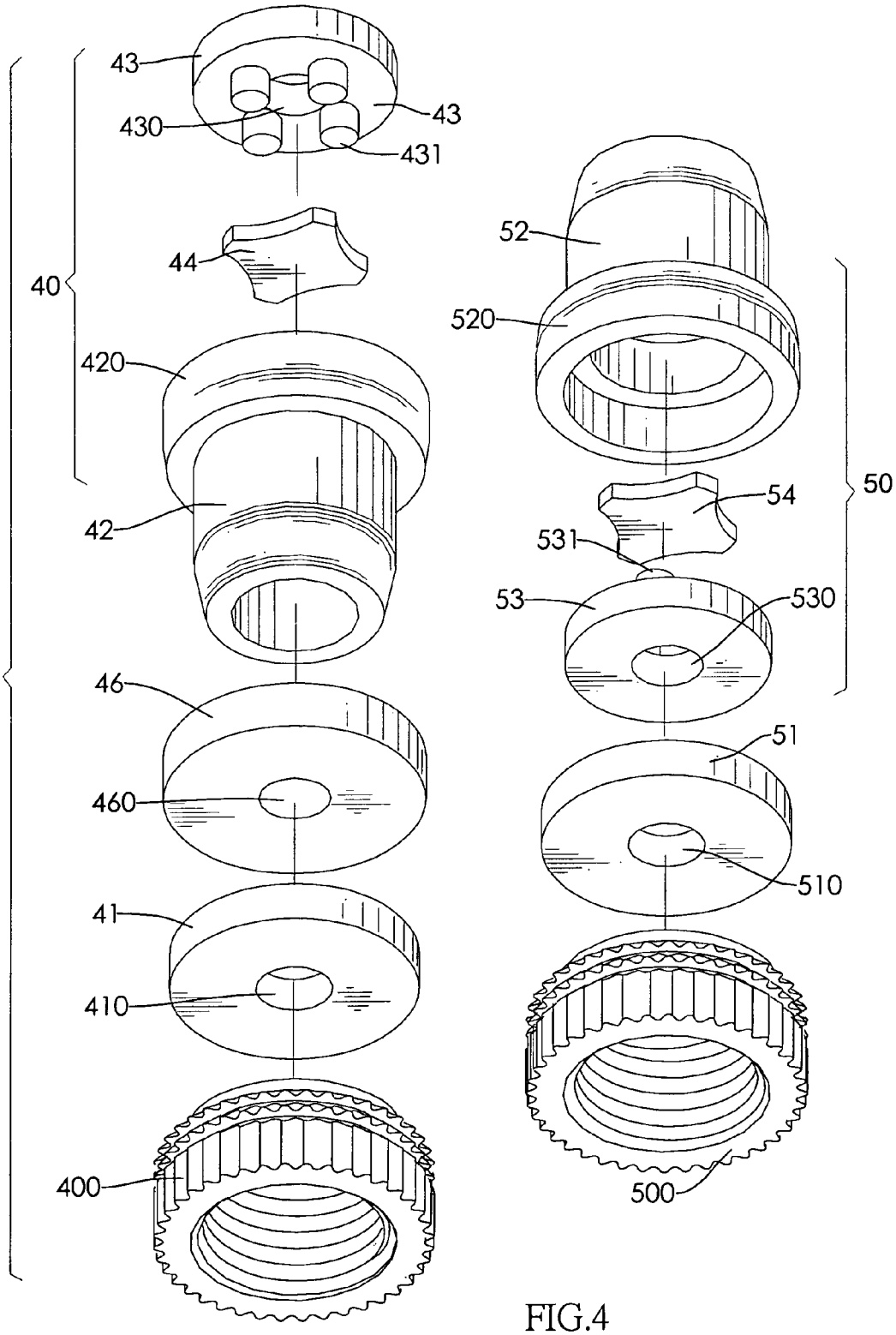
FIG. 4 is an exploded perspective view of the deflating unit and the inflating unit in FIG. 3.
Figure 5:
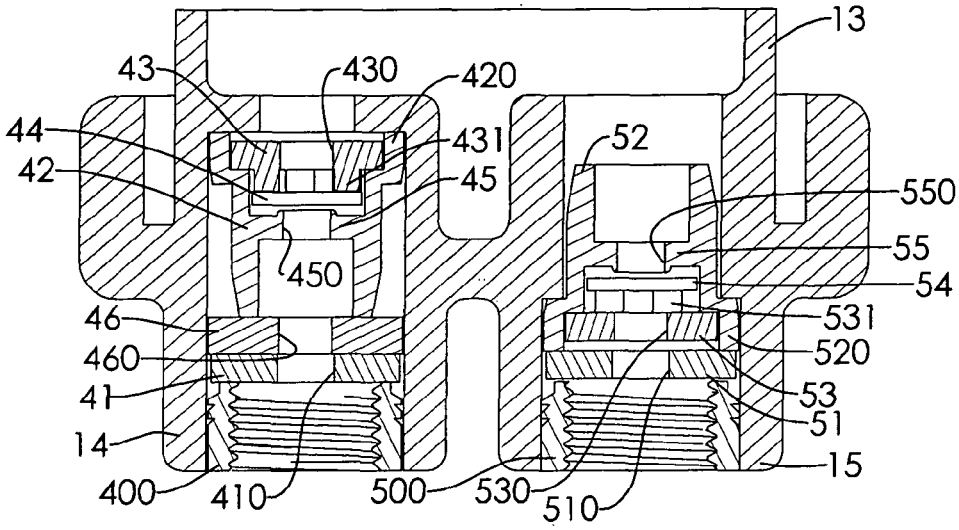
FIG. 5 is an enlarged operational side view in partial section of the hand pump in FIG. 1 when the hand pump is deflating.

With reference to FIGS. 3 to 5, the deflating unit 4 is mounted in the air inlet channel 14 of the pump body 10, and has a check valve 40, a blocking plate 46 and a gasket 41. The check valve 40 has a valve seat 42, an air vent cover 43 and a valve plate 44. The valve seat 42 is hollow and tubular, and has a valve gate 45, a top opening, a bottom opening and an enlarged head 420. The valve gate 45 is formed on and protrudes radially from an inner wall of the valve seat 42 to partition an inner space of the valve seat 42 into an upper compartment and a lower compartment, and has a gate hole 450 formed through the valve gate 45. The top opening is formed through a top of the valve seat 42. The bottom opening is formed through a bottom of the valve seat 42. The enlarged head 420 is formed on an upper portion of a periphery of the valve seat 42 and has expanded outer and inner diameters. An outer wall of the enlarged head 420 abuts against an inner wall of the air inlet channel 14 to hermetically seal an inner end of the air inlet channel 14. The air vent cover 43 is mounted in the upper compartment of the enlarged head 420 and has an air vent hole 430 and multiple stoppers 431. The air vent hole 430 is formed through the air vent cover 43. The stoppers 431 are formed on and protrude from one side of the air valve cover 43 facing the valve gate 45, and are spaced with an interval between each other. The valve plate 44 is movably mounted between the stoppers 431 and the valve gate 45, and has an outer diameter smaller than an inner diameter of the inner wall of the valve seat 42. The blocking plate 46 is mounted underneath the check valve 40, aligns with the bottom opening of the valve seat 42, hermetically abuts against the inner wall of the air inlet channel 14, and has an air hole 460 formed through the blocking plate 46. The gasket 41 is mounted underneath the blocking plate 46 to hermetically seal the bottom opening of the air inlet channel 14, and has an air hole 410 formed therethrough and communicating with that of the blocking plate 46.

The inflating unit 5 is mounted in the air outlet channel 15, and has a check valve 50 and a gasket 51. The check valve 50 may be structurally identical to the check valve 40 in the deflating unit 4 while aligning in a direction reverse to that in the deflating unit 4.

The check valve 50 of the inflating unit 5 has a valve seat 52, an air vent cover 53 and a valve plate 54. The valve seat 52 is hollow and tubular, and has a top opening, a bottom opening, a valve gate 55 and an enlarged head 520. The valve gate 55 is formed on and protrudes radially from an inner wall of the valve seat 52 to partition an inner space of the valve seat 52 into an upper compartment and a lower compartment. The valve gate 55 has a gate hole 550 formed through the valve gate 55. The enlarged head 520 is formed on a lower portion of a periphery of the valve seat 52 and has expanded outer and inner diameters. An outer wall of the enlarged head 520 abuts against an inner wall of the air outlet channel 15 to hermetically seal an outer end of the air outlet channel 15. The air vent cover 53 is mounted in the lower compartment of the enlarged head 520 and has an air vent hole 530 and multiple stoppers 531. The air vent hole 530 is formed through the air vent cover 53. The stoppers 531 are formed on and protrude from one side of the air valve cover 53 facing the valve gate 55, and are spaced with an interval between each other. The valve plate 51 is movably mounted between the stoppers 531 and the valve gate 55, and has an outer diameter smaller than an inner diameter of the inner wall of the valve seat 52. The gasket 51 is mounted underneath the check valve 50 to hermetically seal the bottom opening of the air outlet channel 15, and has an air hole 510 formed through the gasket 51 and communicating with the air vent hole 530 of the air valve cover 53.

The gaskets 41, 51 of the deflating unit 4 and the inflating unit 5 are made of plastic or other substitute material. The valve seats 42, 52 of the check valves 40, 50 are made from Acrylonitrile Butadiene Styrene (ABS) Copolymer or other substitute material. The blocking plate 46 of the deflating unit 4 is made of plastic or other substitute material.

The deflating unit 4 and the inflating unit 5 further respectively have connection rings 400, 500. Each of the connection rings 400, 500 is securely mounted in the air inlet channel 14 or the air outlet channel 15, is adjacent to the bottom opening of the air inlet channel 14 or the air outlet channel 15, and has a threaded hole engaging an air pin to inflate or deflate an inflatable object.

With reference to FIG. 5, during the deflation, the connection ring 400 of the deflating unit 4 engages an air pin mounted through an inflatable object first. The hand grip 21 is held and pulled upwardly so that the piston rod 20 is moved upwardly and air enters the pump body 10. The valve plate 44 of the check valve of the deflating unit 4 is pushed by air to move upwardly and abut against the stoppers 431 of the air vent cover 43. Air sequentially passes through the air holes 410, 460 of the gasket 41, the blocking plate 46 to enter the valve seat 42. As the gate hole 450 in the valve seat 42 is open, air can further pass through the gate hole 450, flow to the space between the stoppers 431 of the air vent cover 43, and enter the pump body 10. Meanwhile, the valve plate 54 of the check valve 50 of the inflating unit 5 is pushed by air outside the pump body 10 to move upwardly so that the valve plate 54 abuts against the valve gate 55 in the valve seat 52 and seals the gate hole 550, and air is unable to enter the pump body 10 through the air outlet channel 5.

Figure 6:
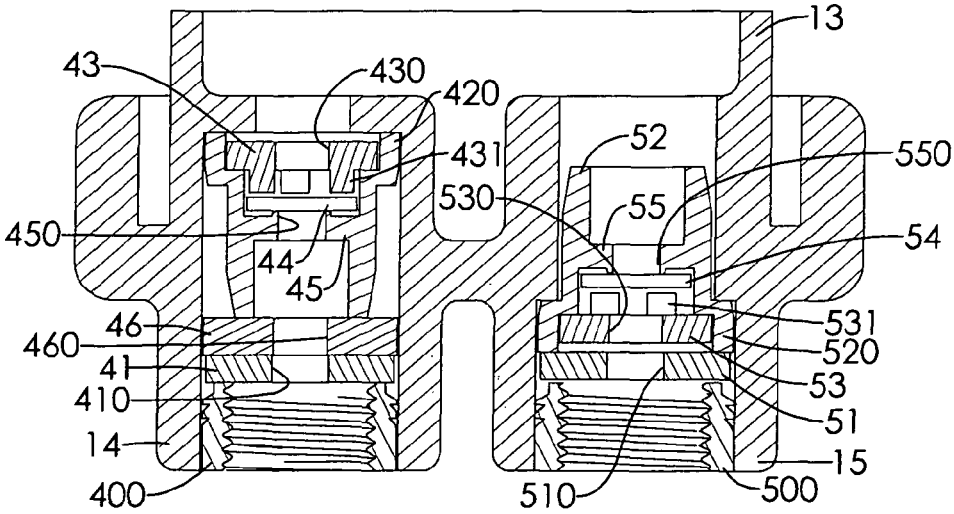
FIG. 6 is an enlarged operational side view in partial section of the hand pump in FIG. 1 when the hand pump is inflating.

With reference to FIG. 6, when the hand grip 21 is pushed and the piston rod 20 is moved downwardly, the valve plate 44 of the deflating unit 4 is pushed by air to move downwardly and seal the gate hole 450 so that air will not flow out through the air inlet channel 14. The valve plate 54 of the inflating unit 5 is pushed by air to move downwardly and abut against the stoppers 531 of the air vent cover 53. Hence, air can pass through the gate hole 550 of the valve seat 52 and flow to the space between the stoppers 531 of the air vent cover 53, and flow out of the pump body 10 through the air vent hole 530 of the air vent cover 53 and the air hole 510 of the gasket 51.

During the inflation, the connection ring 500 of the inflating unit 5 engages an air pin mounted through an inflatable object first. The hand grip 21 is held and pulled up and pressed down continuously. As mentioned above, when the piston rod 20 is moved upwardly, air enters the pump body 10 through the air inlet channel 14. When the piston rod 20 is moved downwardly, air can only flow out of the pump body 10 through the air outlet channel 15 so as to inflate the inflatable object through the air pin mounted through the inflatable object and connected with the connection ring 500.

Figure 7:
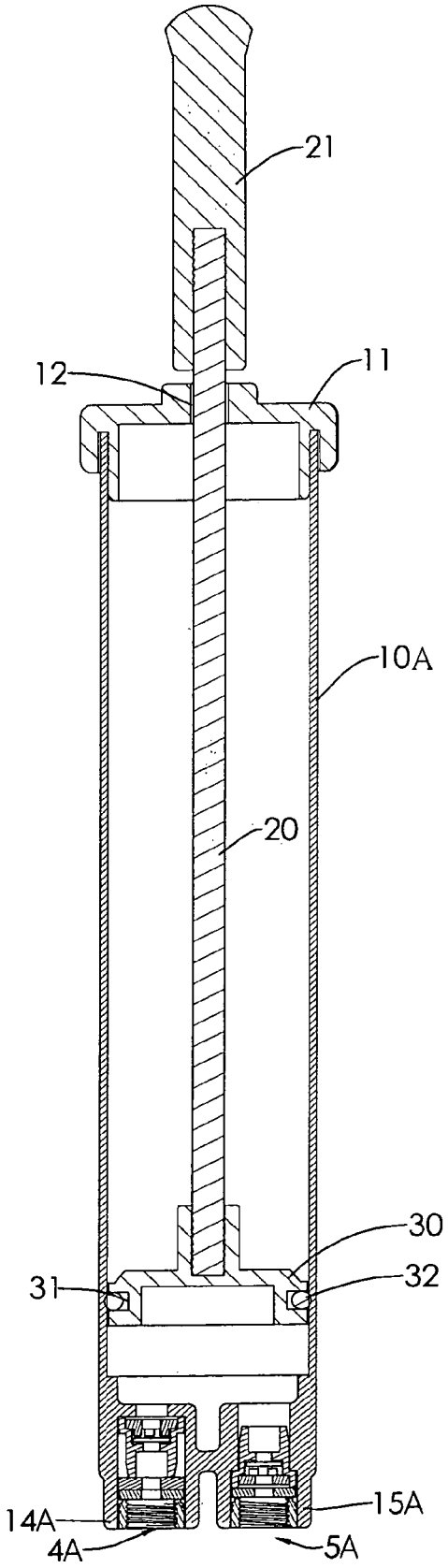
FIG. 7 is a side view in partial section of a second embodiment of a dual duty hand pump in accordance with the present invention.
Figure 8:
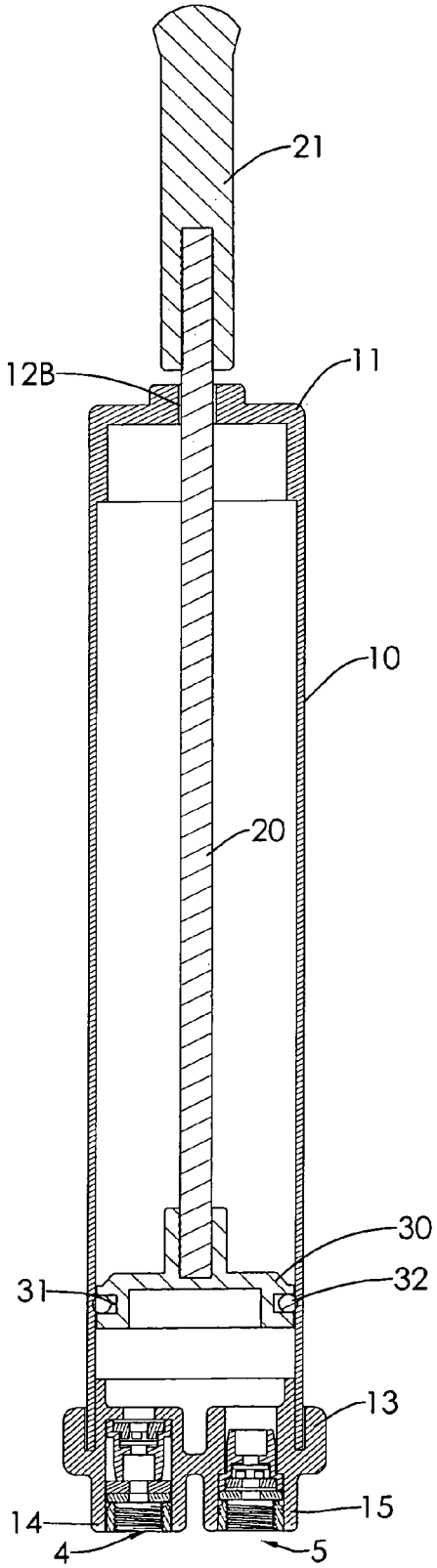
FIG. 8 is a side view in partial section of a third embodiment of a dual duty hand pump in accordance with the present invention.

With reference to FIG. 7, an air inlet channel 14A and an air outlet channel 15A are respectively and integrally formed through the pump body 10A. The deflating unit 4A and the inflating unit 5A are respectively mounted in the air inlet channel 14A and the air outlet channel 15A. With reference to FIG. 8, a through hole 12B is integrally formed through a top end of the pump body. The piston rod 20B is mounted through the through hole 12B.

With the check valves 40, 50 mounted oppositely in the air inlet channel 14 and the air outlet channel 15, air can only flow in and out of the pump body 10 through one specific channel 14, 15. When an inflatable object is connected to the air inlet channel 14 or the air outlet channel 15 of the pump body, repeatedly moving the hand grip or the piston rod 20 up and down can deflate or inflate the inflatable object. Accordingly, the dual duty hand pump provides a practical and convenient solution to integrate inflating and deflating functions as a whole.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A dual duty hand pump, comprising:

a hand grip;

a pump body being hollow and having:

a through hole formed through one end of the pump body and adapted to communicate with outside of the pump body; and an air inlet and an air outlet channel through the other end of the pump body and adapted to communicate with outside of the pump body;

a piston rod mounted in the pump body and through the through hole of the pump body, wherein one end of the piston rod is connected with the hand grip;

a piston securely mounted on the other end of the piston rod and having a seal ring sealed against an inner wall of the pump body;

a deflating unit mounted in the air inlet channel and having:

a check valve through which air flows in a first direction, the check valve having:

a valve seat being hollow and having a valve gate formed on and protruding radially from an inner wall of the valve seat to partition an inner space of the valve seat into an upper compartment and a lower compartment;

an air vent cover mounted in the upper compartment and having:

an air vent hole formed through the air vent cover; and multiple stoppers formed on and protruding from one side of the air vent cover facing the valve gate, and spaced with an interval between each other; and a valve plate movably mounted between the stoppers and the valve gate; and a connection ring securely mounted in the air inlet channel, being adjacent to a bottom opening of the air inlet channel, and having a threaded hole adapted to engage an air pin;

an inflating unit mounted in the air outlet channel and having:

a check valve through which air flows in a second direction opposite to the first direction; and a connection ring securely mounted in the air outlet channel, being adjacent to a bottom opening of the air outlet channel, and having a threaded hole adapted to engage an air pin.

2. The dual duty hand pump as claimed in claim 1, wherein the check valve of the inflating unit has:

a valve seat being hollow and having:

a top;

a bottom;

a valve gate formed on and protruding radially from an inner wall of the valve seat to partition an inner space of the valve seat into an upper compartment and a lower compartment;

a top opening formed through the top of the valve seat; and a bottom opening formed through the bottom of the valve seat;

an air vent cover mounted in the lower compartment and having:

an air vent hole formed through the air vent cover; and multiple stoppers formed on and protruding from one side of the air vent cover facing the valve gate, and spaced with an interval between each other; and a valve plate movably mounted between the stoppers and the valve gate.

3. The dual duty hand pump as claimed in claim 1, wherein the valve gate of the check valve of the deflating unit has a gate hole formed through the valve gate.

4. The dual duty hand pump as claimed in claim 2, wherein the valve gate of the check valve of each of the deflating unit and the inflating unit has a gate hole formed through the valve gate.

5. The dual duty hand pump as claimed in claim 3, wherein the deflating unit has a gasket, and the gasket is mounted between the check valve and the connection ring and has an air hole formed therethrough communicating with the air vent hole of the air vent cover.

6. The dual duty hand pump as claimed in claim 4, wherein each of the deflating unit and the inflating unit has a gasket, each of the gaskets is mounted between a corresponding check valve and a corresponding connection ring and has an air hole formed therethrough communicating with the air vent hole of the air vent cover.

7. The dual duty hand pump as claimed in claim 5, wherein the valve seat of the check valve of the deflating unit further has an enlarged head formed on an upper portion of a periphery of the valve seat and having expanded outer and inner diameters, and an outer wall of the enlarged head abuts against an inner wall of the air inlet channel to hermetically seal an inner end of the air inlet channel.

8. The dual duty hand pump as claimed in claim 6, wherein the valve seat of the check valve of each one of the deflating unit and the inflating unit further has an enlarged head formed on an upper portion of a periphery of the valve seat and having expanded outer and inner diameters, and an outer wall of the enlarged head abuts against an inner wall of the air inlet channel to hermetically seal an inner end of the air inlet channel.

9. The dual duty hand pump as claimed in claim 7, wherein the deflating unit further has a blocking plate mounted between the check valve and the gasket of the deflating unit, and the blocking plate aligns with the bottom opening of the valve seat of the deflating unit, hermetically abuts against the inner wall of the air inlet channel, and has an air hole formed through the blocking plate and communicating with the air hole of the gasket of the deflating unit.

10. The dual duty hand pump as claimed in claim 8, wherein the deflating unit further has a blocking plate mounted between the check valve and the gasket of the deflating unit, and the blocking plate aligns with the bottom opening of the valve seat of the deflating unit, hermetically abuts against the inner wall of the inlet channel, and has an air hole formed through the blocking plate and communicating with the air hole of the gasket of the deflating unit.

11. The dual duty hand pump as claimed in claim 3, wherein the piston further has an annular slot formed in a periphery of the piston, and the seal ring of the piston is mounted in the annular slot.

12. The dual duty hand pump as claimed in claim 4, wherein the piston further has an annular slot formed in a periphery of the piston, and the seal ring of the piston is mounted in the annular slot.

13. The dual duty hand pump as claimed in claim 5, wherein the piston further has an annular slot formed in a periphery of the piston, and the seal ring of the piston is mounted in the annular slot.

14. The dual duty hand pump as claimed in claim 6, wherein the piston further has an annular slot formed in a periphery of the piston, and the seal ring of the piston is mounted in the annular slot.

15. The dual duty hand pump as claimed in claim 7, wherein the piston further has an annular slot formed in a periphery of the piston, and the seal ring of the piston is mounted in the annular slot.

16. The dual duty hand pump as claimed in claim 8, wherein the piston further has an annular slot formed in a periphery of the piston, and the seal ring of the piston is mounted in the annular slot.

17. The dual duty hand pump as claimed in claim 9, wherein the piston further has an annular slot formed in a periphery of the piston, and the seal ring of the piston is mounted in the annular slot.

18. The dual duty hand pump as claimed in claim 10, wherein the piston further has an annular slot formed in a periphery of the piston, and the seal ring of the piston is mounted in the annular slot.

* * * * *